United States Patent [19]

Manso

[11] 4,150,807

[45] Apr. 24, 1979

[54] BOOK HOLDING DEVICE

[76] Inventor: Hipolito S. Manso, 95 Ten Eyck Walk, Brooklyn, N.Y. 11206

[21] Appl. No.: 805,080

[22] Filed: Jun. 9, 1977

[51] Int. Cl.[2] ..... A47B 97/04

[52] U.S. Cl. ..... 248/452; 248/460

[58] Field of Search ..... 248/452, 455, 456, 460

[56] References Cited

U.S. PATENT DOCUMENTS

| | | | |
|---|---|---|---|
| 511,585 | 12/1893 | Carter | 248/456 |
| 1,086,906 | 2/1914 | Felten | 248/456 |
| 2,003,746 | 6/1935 | Headington | 248/452 |
| 2,219,091 | 10/1940 | Henderson | 248/452 |
| 2,792,668 | 5/1957 | Gallamos | 248/456 |
| 3,381,928 | 5/1968 | White | 248/455 |
| 3,999,734 | 12/1976 | Gibson | 248/460 |

*Primary Examiner*—William H. Schultz

[57] ABSTRACT

This device consists primarily of a base, which includes a front panel, having a pair of elevatable hooks, which will render a book, or other reading matter, secure in open position, so as to enable a person to read comfortably without holding the book with his or her hands, and one of the hooks of the device includes a small spring, for holding the side of the book having a few pages clustered together.

1 Claim, 5 Drawing Figures

FIG. 1
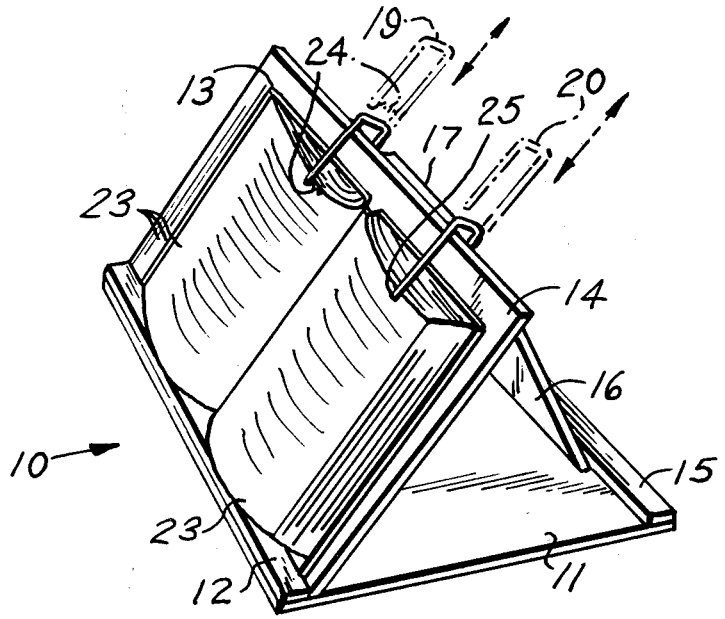
FIG. 2
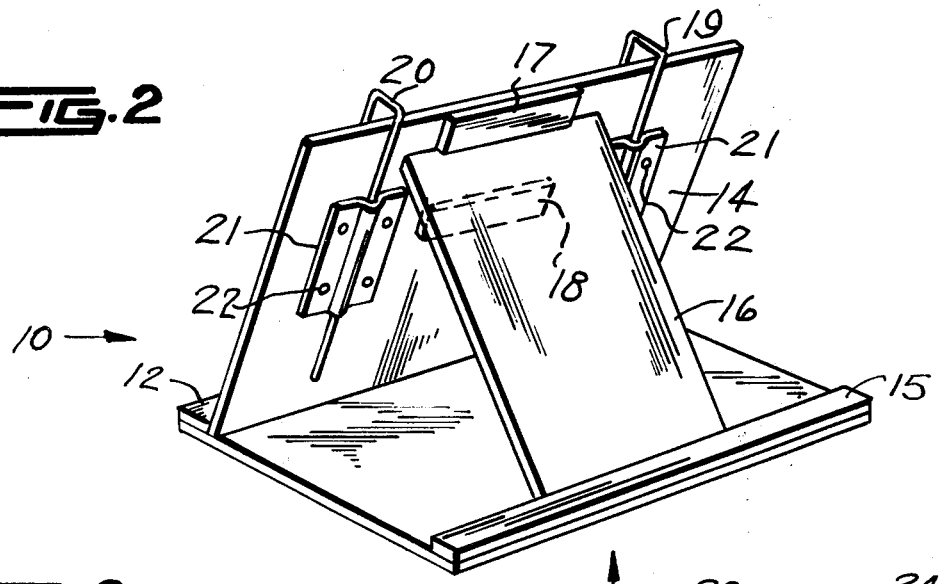
FIG. 3
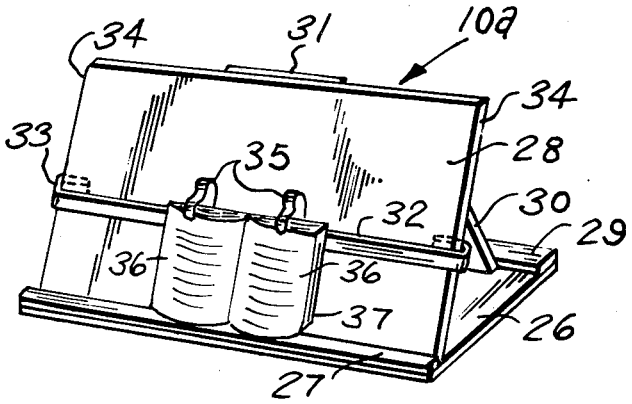
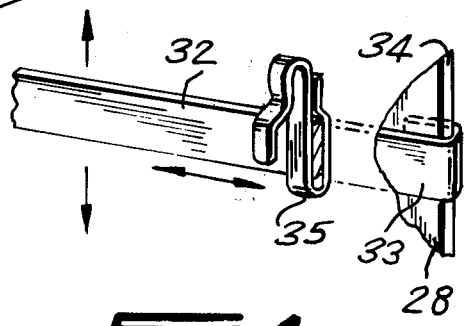
FIG. 4

BOOK HOLDING DEVICE

This invention relates to support devices, and more particularly, to a book holding device.

It is, therefore, the principal object of this invention, to provide a book holding device, which will enable a person to read a book or other material, without holding it with his or her hands. The aforementioned is particularly true, when a person's hands are occupied with writing down notes taken from the book.

Another object of this invention is to provide a book holding device, which will have elevatable hooks for holding the pages of the book stationary, and the hooks may be effortlessly lifted when it is desired to place a book in the device.

A further object of this invention is to provide a book holding device, which will hold and support the book at a proper angle.

A still further object of this invention is to provide a book holding device, of the type described, which will be particularly adaptable for use by a person who is relaxing in a chair, or a bed, and the device will be useful to a person who is preparing food from a recipe, while preventing the soiling of the pages of the book with food ingredients.

Other objects of the invention are to provide a book holding device, which is simple in design, inexpensive to manufacture, rugged in construction, easy to use and efficient in operation.

These, and other objects, will be readily evident, upon a study of the following specification, and the accompanying drawing, wherein:

FIG. 1 is a perspective view of the present invention, showing the raised position of the hooks in phantom lines;

FIG. 2 is a perspective view, showing the rear of the invention;

FIG. 3 is a perspective view of a modified form of the invention, which is more adaptable for holding either larger or smaller books; and FIG. 4 is an enlarged, fragmentary, perspective view of FIG. 3.

Figure 5:
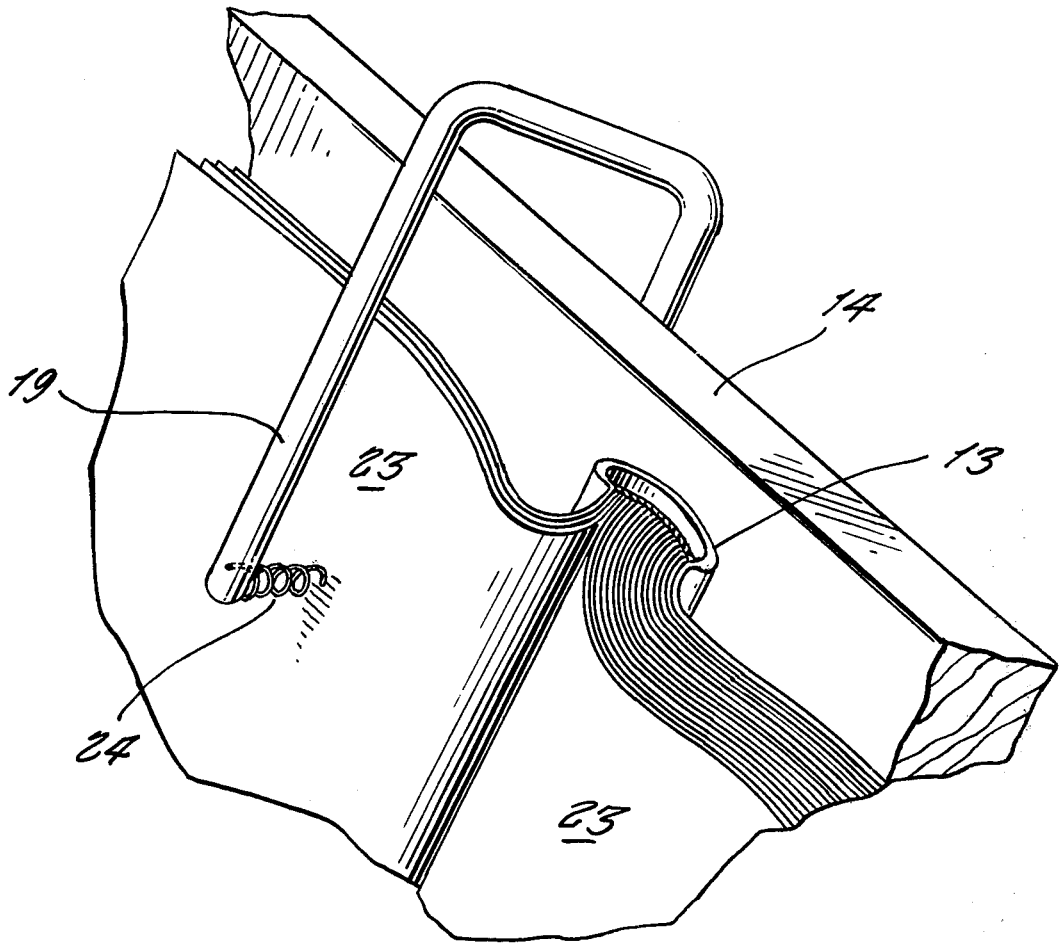
FIG. 5 is an enlarged detail view of one of the wire hooks illustrated in Figure one, so as to more clearly show a spring on an end thereof.

According to this invention, a book holding device 10, is shown to include a rectangular base 11, having secured fixedly thereto, an elongated strip 12, which serves as foot means to support the bottom of book 13 on the panel 14, which is rectangular in configuration. An elongated strip 15 is fixedly secured to the base 11 on its opposite side, and serves as foot means, against which one edge of brace 16 will rest. Brace 16, at its opposite end, abuts with strip 17. A second strip 18 is parallel spaced apart from strip 17, and is fixedly secured to panel 14, so as to enable the reader to change the angle of panel 14, if desired.

A pair of spaced apart wire hooks 19 and 20 are each elevatable in a bracket 21. The brackets 21 are fixedly secured to the rear of panel 14, by suitable fasteners 22. The "U" shaped portions of hooks 19 and 20 serve as retaining means for the pages 23 of book 13. A spring 24 is secured to one of the hooks 19 and 20, so as to be used to hold the pages 23 on either the left or right side of the book, depending on which side has the least pages.

As clearly shown in FIGS. 1 and 5 of the drawing, the spring 24 is of coil type, and is located at the terminal end of the wire hook, and is affixed thereto, so as to bear in a direction directly toward the book page. The U-shaped hook is relatively thick, and accordingly relatively stiffer than the spring 24. The spring thus fills the gap between the wire front leg and the opened book, when there is only a thin amount of pages to be held thereby. Without the tension of the spring 24 against the pages, if few in number, the pages would swing forwardly until they engage the hook leg, instead of lying flat against the panel.

In use, a person, wishing to turn a page 23, simply slides the upper edge of the page 23 from under the hook 20, turns the page 23, and then slips the page 23 under the hook 19 bearing on the opposite page 23.

It shall be noted, that, after using device 10, it may be folded with or without a book 13 therein, by laying the brace 16 down.

Referring now to the modified form 10*a*, as shown in FIGS. 3 and 4, a base 26 includes a strip 27, which serves as foot means for panel 28, which is held at an angle, in a similar manner as shown in the main embodiment of the invention. Strip 29 serves as foot means for the brace 30, and the upper end of brace 30 abuts with strip 31. A spring steel bar 32 has hook ends 33, which springingly engage edges 34 of panel 28, so as to enable bar 32 to be raised or lowered to fit various size books. The substantially "S" shaped spring hooks 35 are snapped on to bar 32 at one end, and are slidable on bar 32. The opposite ends of hooks 35 serve as a means for clampingly engaging the pages 36 of book 37.

While various changes may be made in the detail construction, it is understood that such changes will be within the spirit and scope of the present invention, as defined by the appended claims:

What I now claim is:

1. A book holding device, comprising, in combination, a rectangular, horizontal base, a strip secured upon a forward edge of said base, a second strip secured upon a rear side of said base, a rectangular panel rested in inclined position upon said base, a lower edge of said panel abutting against the first said strip, an upper rear portion of said panel having a plurality of spaced apart blocks secured thereto, an upper edge of a brace selectively abutting against a lower edge of either of said blocks, a lower edge of said brace abutting against the second said strip at said rear edge of said base; a pair of spaced-apart, inverted "U"-shaped wire hooks extending around an upper edge of said inclined panel, one leg of each said hook being slidably supported in a bracket mounted on said panel rear side, the other leg of each said hook being forwardly of a front side of said panel for retaining an open book between said panel front side and said hook other legs, and a spring being secured to one of said hooks, at an end of said other leg, said spring engaging a surface of a page of said opened book having only a few other pages therebehind, at either a right or left side of said book.

* * * * *